US012102195B1

(12) United States Patent
Cipolla

(10) Patent No.: US 12,102,195 B1
(45) Date of Patent: Oct. 1, 2024

(54) JEWELRY ITEM AND CHARM

(71) Applicant: Steven A. Cipolla, Warwick, RI (US)

(72) Inventor: Steven A. Cipolla, Warwick, RI (US)

(73) Assignee: National Chain Company, Warwick, RI (US)

( * ) Notice: Subject to any disclaimer, the term of this patent is extended or adjusted under 35 U.S.C. 154(b) by 0 days.

(21) Appl. No.: 18/125,244

(22) Filed: Mar. 23, 2023

(51) Int. Cl.
*A44C 25/00* (2006.01)
*A44C 5/00* (2006.01)
*A44C 15/00* (2006.01)

(52) U.S. Cl.
CPC ..... *A44C 25/007* (2013.01); *A44C 5/00* (2013.01); *A44C 15/005* (2013.01)

(58) Field of Classification Search
CPC ..... A44C 25/007; A44C 5/00; A44C 15/005; A44C 5/0007; A44C 9/0061; A44C 13/00; A44C 17/0208; A44C 17/0216; A44C 25/001; A44C 7/003; A44B 6/00
See application file for complete search history.

(56) References Cited

U.S. PATENT DOCUMENTS 6,131,408 A * 10/2000 Gill ..... A44C 9/00 63/15
7,698,836 B2 * 4/2010 Schmelzer ..... A43B 23/24 36/137
7,891,117 B2 2/2011 Sack
7,930,900 B2 4/2011 Kim-Araneo
8,069,538 B2 * 12/2011 Wilcox ..... A43C 1/00 24/628
9,021,833 B2 5/2015 Arjang et al.
9,877,552 B2 1/2018 Petrosyan
10,064,441 B1 9/2018 Provencher
10,342,302 B2 7/2019 Clark
10,993,514 B2 5/2021 Wright et al.
2007/0094776 A1 * 5/2007 Stevens ..... A41F 9/002 2/338
2013/0160490 A1 * 6/2013 Aoki ..... A43B 3/0078 63/23
2013/0160491 A1 * 6/2013 Hedrick ..... G02C 11/02 63/40
2015/0096328 A1 * 4/2015 Schwartz ..... A44C 15/0015 63/1.13
2017/0224070 A1 * 8/2017 Simones ..... A44C 5/0053
2020/0100571 A1 * 4/2020 Green ..... A44C 17/0225
2021/0321728 A1 * 10/2021 Zanghi ..... A44C 5/0053
2024/0041169 A1 * 2/2024 Fabbri ..... A44C 25/001

* cited by examiner

*Primary Examiner* — Jack W Lavinder
(74) *Attorney, Agent, or Firm* — Salter & Michaelson

(57) ABSTRACT

A jewelry item that is for support from the body of a user in order to display the jewelry item. The jewelry item includes a base member and at least one charm that is for support from the base member, the charm having a display end where an indicia piece is formed and a support end in the form of an elongated support post. The base member includes at least one opening for receiving the support post of the charm so as to retain the charm in place relative to the base member.

15 Claims, 4 Drawing Sheets

JEWELRY ITEM AND CHARM

TECHNICAL FIELD

The present invention relates in general to a jewelry item and pertains, more particularly, to an item that is used for the support of one or more charms.

BACKGROUND OF THE INVENTION

There are several prior art references that describe jewelry items. For example, U.S. Pat. No. 10,342,302 to Clark describes an identification charm bracelet. However, any of the existing products do not provide a ready way for attaching a charm to a base member which is in turn supported, in one embodiment, from a necklace chain.

Accordingly, it is an object of the present invention to provide a jewelry item that is for support from the body of a user in order to display the jewelry item.

Another object of the present invention is to provide an improved jewelry item that is comprised of a base member and at least one charm that is removeably supported from the base member. In this regard the base member includes at least one opening for receiving a support post of the charm so as to retain the charm in place relative to the base member.

SUMMARY OF THE INVENTION

To accomplish the foregoing and other objects and advantages of the present invention there Is provided a jewelry item that is for support from the body of a user in order to display the jewelry item. In accordance with the present invention the jewelry item comprises a base member and at least one charm that is for support from the base member, the charm having a display end where an indicia piece is formed and a support end in the form of an elongated support post. The base member includes at least one opening for receiving the support post of the charm so as to retain the charm in place relative to the base member.

In accordance with other aspects of the present invention the indicia piece is in the form of a letter, number, image or symbol; the symbol or image is in the form of a geometric shape, an emoji or a descriptive print; the base member has a plurality of openings spaced along a longitudinal axis of the base member; further including a partially spherical securing member that is attached at a rear surface of the base member and about the opening; wherein the elongated support post at the support end of the charm has a distal end ridge piece for engagement with the opening in the base member and the partially spherical securing member so as to retain the charm to the base member; including at least one loop on the base member that enables the jewelry item to be hung from a necklace or bracelet; wherein the loop is provided at opposite ends of the base member or is provided at an intermediate location of the base member; and wherein the base member extends either linearly or in an arcuate manner.

In accordance with another version of the present invention there is provided a jewelry item that is meant for support from a necklace or bracelet for displaying at least one charm. The jewelry item further includes a base member from which the at least one charm is for supported, the charm having a display end where an indicia piece is formed and a support end in the form of an elongated support post. The base member includes at least one opening for receiving the support post of the charm so as to retain the charm in place relative to the base member.

In accordance with still other aspects of the present invention the base member has a plurality of openings spaced along a locus of the base member, and including a rear retaining piece disposed at a rear surface of the base member and about each opening, wherein the elongated support post at the support end of the charm has a distal end ridge piece for engagement with the opening in the base member and the rear retaining piece so as to retain the charm to the base member; the indicia piece is in the form of a letter, number, image or symbol; the symbol or image is in the form of a geometric shape, an emoji or a descriptive print; including at least one loop on the base member that enables the jewelry item to be hung from a necklace or bracelet; wherein a loop is provided at either opposite ends of the base member or at an intermediate location of the base member; and wherein the base member extends either linearly or in an arcuate manner.

In accordance with still another version of the present invention there is provided a jewelry item that is meant for support from a necklace or bracelet for displaying at least one charm, the jewelry item further including a base member from which the at least one charm is for supported, the charm having a display end where an indicia piece is formed and a support end in the form of an elongated support post. The base member includes at least one opening for receiving the support post of the charm so as to retain the charm in place relative to the base member, wherein the base member has a plurality of openings spaced along a locus of the base member, and including a rear retaining piece disposed at a rear surface of the base member and about each opening, wherein the elongated support post at the support end of the charm has a distal end ridge piece for engagement with the opening in the base member and for engagement with the rear retaining piece so as to retain the charm to the base member, wherein the indicia piece is in the form of a letter, and where adjacent indicia pieces are determined to form a word or name; and including at least one loop on the base member that enables the jewelry item to be hung from the necklace or bracelet.

BRIEF DESCRIPTION OF THE DRAWINGS

It should be understood that the drawings are provided for the purpose of illustration only and are not intended to define the limits of the disclosure. The foregoing and other objects and advantages of the embodiments described herein will become apparent with reference to the following detailed description when taken in conjunction with the accompanying drawings in which.

DETAILED DESCRIPTION

Figure 7:
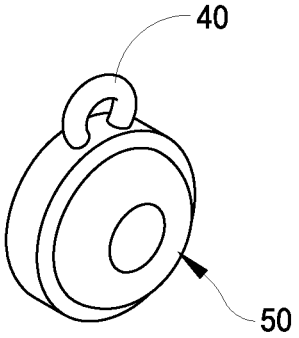
FIG. 7 is a perspective view of an alternate embodiment meant to support a single charm.
Figure 8:
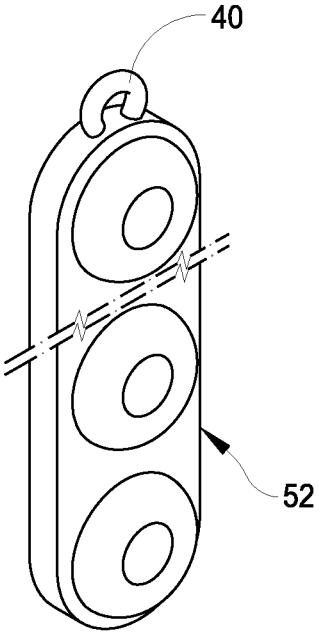
FIG. 8 is a perspective view of another embodiment of the present invention in which the base member is hung vertically.
Figure 9:
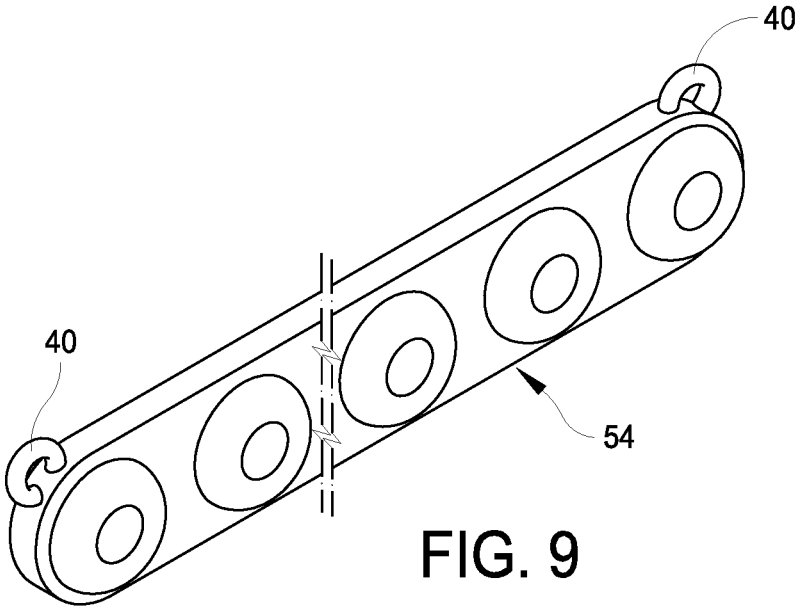
FIG. 9 is a perspective view of the jewelry item having additional ports for receiving up to five charms.
Figure 10:
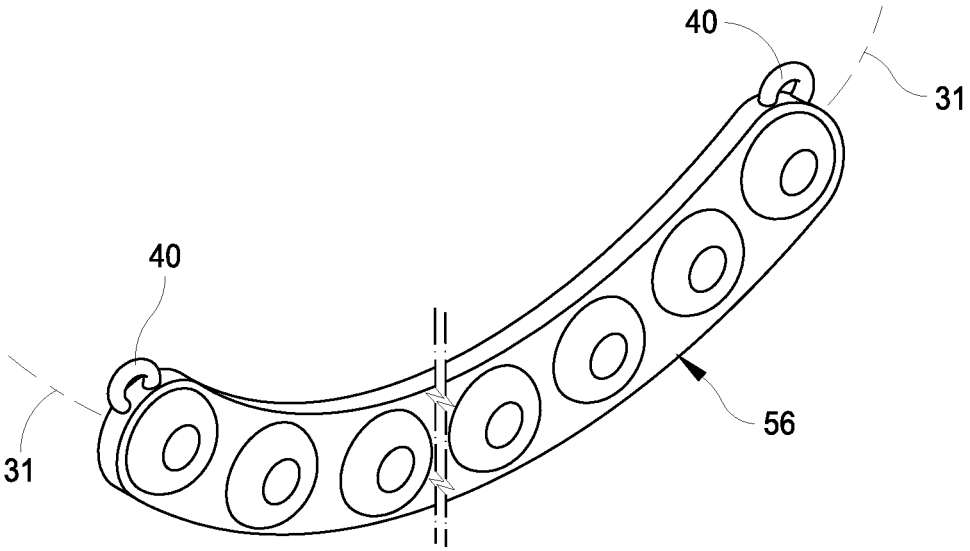
FIG. 10 is a further alternate embodiment of the present invention in which the base member is arcuate in shape.

Refer to a first embodiment of the present invention that is illustrated in FIGS. 1-6. FIG. 7 is a perspective view of an alternate embodiment meant to support a single charm. FIG. 8 is a perspective view of another embodiment of the present invention in which the base member is hung vertically. FIG. 9 is a perspective view of the jewelry item having additional ports for receiving up to five charms. FIG. 10 is a further alternate embodiment of the present invention in which the base member is arcuate in shape. In the embodiments in FIGS. 7-10, basically the same structure is used such as illustrated in the cross-sectional view of FIG. 3 and in FIGS. 5 and 6. Thus, in each of the embodiments shown in FIGS. 7-10 there is provided either a single support loop 40 or a pair of support loops. In FIGS. 7 and 8 there is a single support loop 40 provided while in FIGS. 9 and 10 there are support loops 40 at both ends of the base member.

Figure 1:
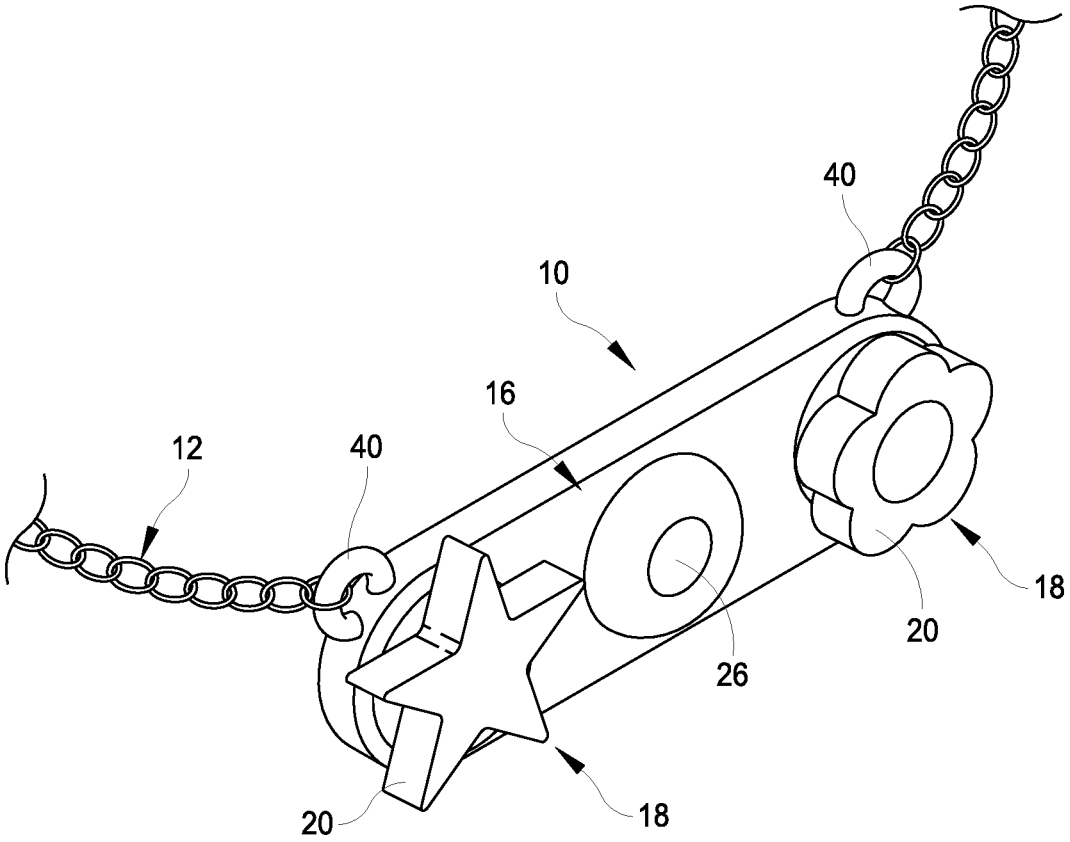
FIG. 1 is a perspective view showing the jewelry item of the present invention as secured to a necklace chain.
Figure 2:
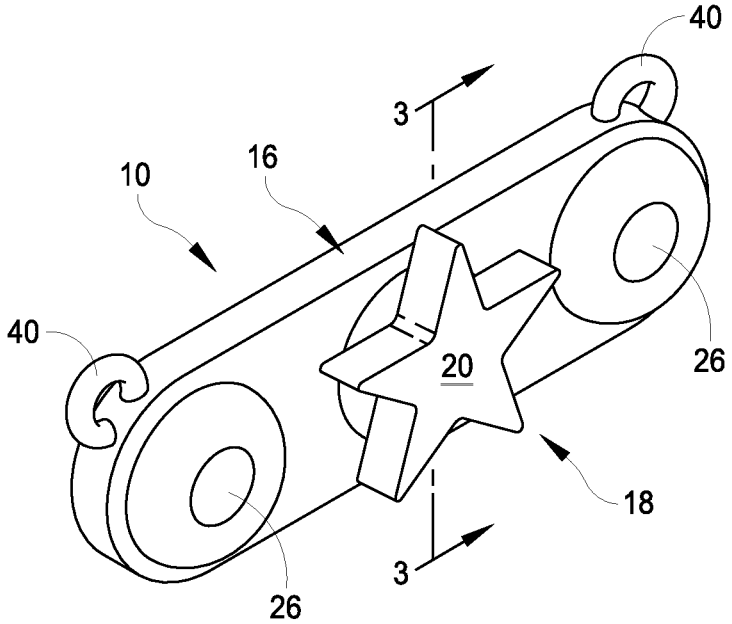
FIG. 2 is a perspective view similar to that shown in FIG. 1 with the charm engaged in a different position.
Figure 3:
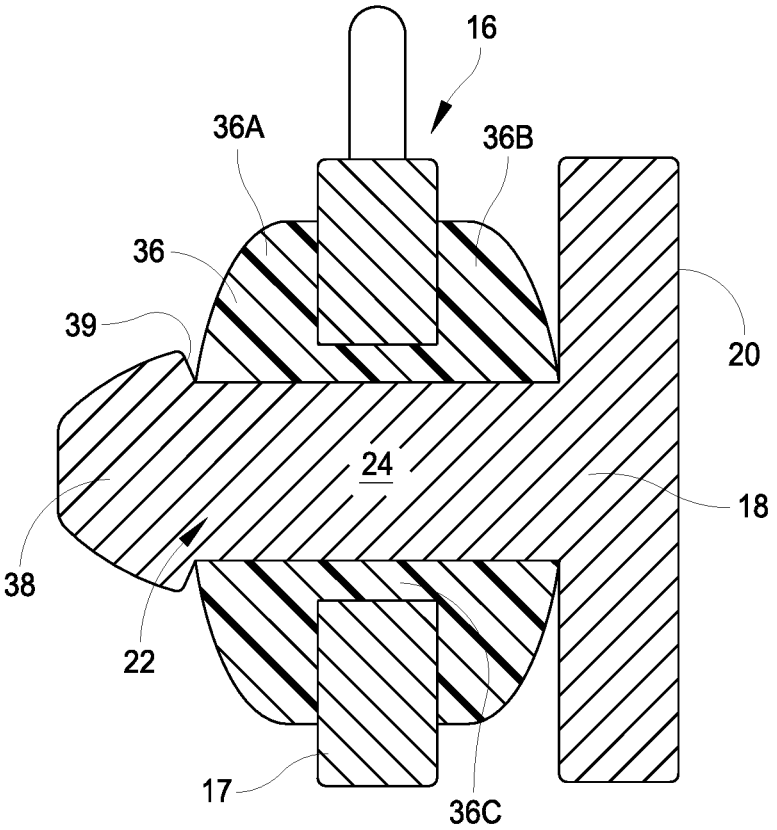
FIG. 3 is a cross-sectional view taken along line 3-3 of FIG. 2.
Figure 4:
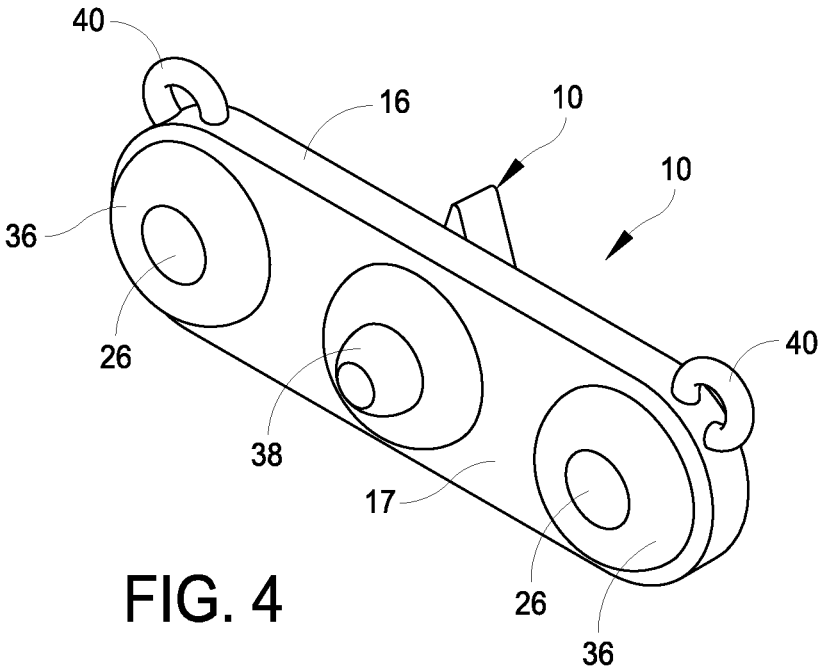
FIG. 4 is a rear perspective view of the same jewelry item shown in FIGS. 1 and 2.

Thus, in FIGS. 1-6 there is provided a jewelry item 10 that is shown supported from a necklace chain 12. This support is provided by means of the support loops 40 as illustrated in FIGS. 1 and 2. The loops 40 are attached to the base member 16. The base member 16 may be constructed of a soft plastic material or virtually any other material. FIGS. 1 and 2 illustrate front perspective views of the base member 16 while FIG. 4 illustrates a rear perspective view. FIG. 3 is a cross-sectional view taken along line 3-3 of FIG. 2.

Figure 5:
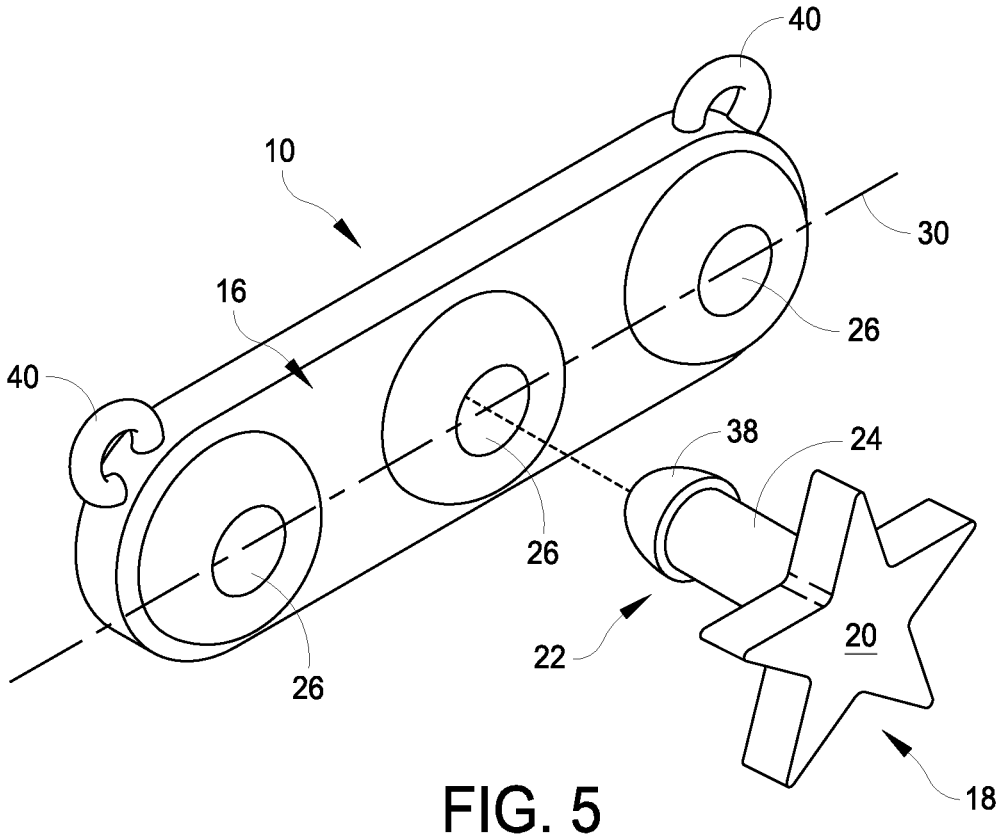
FIG. 5 is a front perspective view showing the charm engaged at an opening in the base member.
Figure 6:
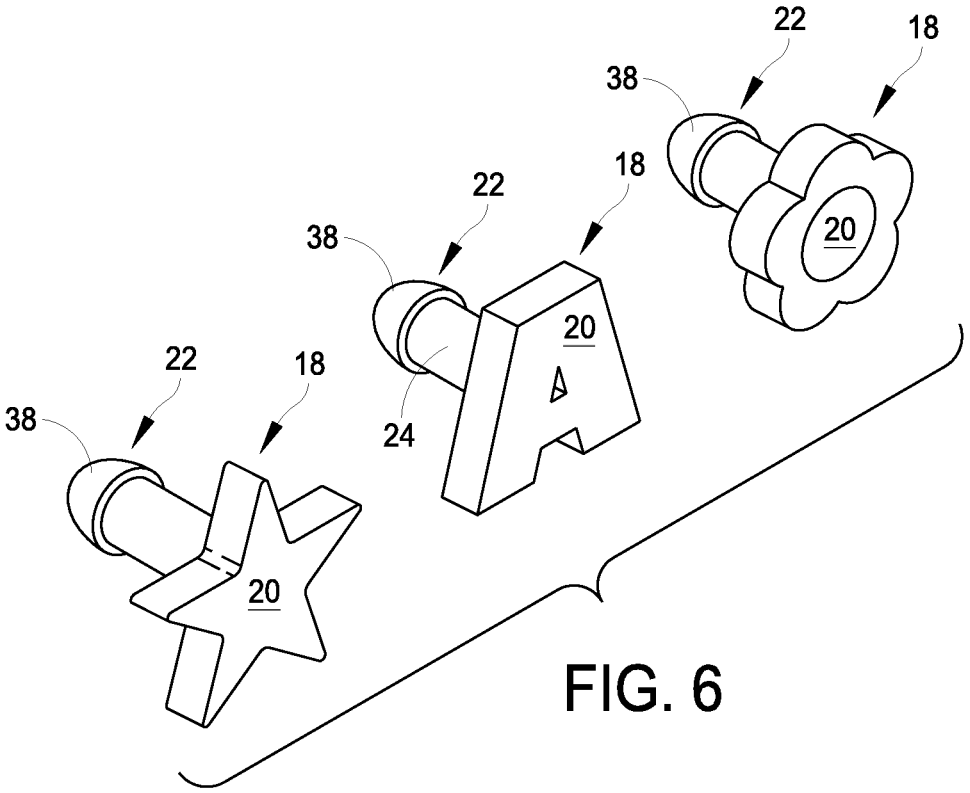
FIG. 6 shows a series of different charms.

The base member 16 is for support of a plurality of charms 18. The charm 18 may be considered as having a display end illustrated at 20 and a support end as illustrated at 22. Refer to three different charm constructions shown in respective perspective views in FIG. 6. The support end of each charm is formed primarily by an elongated support post 24. Refer to FIGS. 3-6 that illustrate this post 24. The post 24 is either attached to the main base member 16 or is integral therewith as shown in the cross-sectional view of FIG. 3. The elongated support post 24 is meant to be received in the base member opening 26. FIG. 5 illustrates one charm 18 with its support post 24 in alignment with the opening 26 in the base member 16.

Refer to the cross-sectional view of FIG. 3 and rear perspective view of FIG. 4. This illustrates the rear surface 17 of the base member. Also note in the cross-sectional view of FIG. 3 that there is a partially spherical or parabolic securing member 36 that is essentially supported within a passage in the base member 16. FIG. 3 illustrates a rear side of the securing member at 36A, a front side of the securing member at 36B and a connecting piece of the securing member at 36C.

In FIG. 5 as the charm is inserted in the opening 26, it is noted that the elongated support post 24 is provided with an interlocking edge as illustrated at 39 in FIG. 2. As also illustrated in the cross-sectional view of FIG. 3, the support post 24 terminates at a distal end ridge piece 38. It is the transition between the post 24 and the ridge piece 38 that defines the interlocking edge. The dimensions of the ridge piece are selected so that the charm can be easily urged into the position shown in FIG. 3 but likewise can be withdrawn by the application of pressure to withdraw the charm. The materials of both the support post, particularly at the ridge piece 38, as well as the securing member 36 are constructed of a pliable material such as a relatively soft rubber material. In that way there is a firm engagement such as illustrated in FIG. 3 while at the same time enabling the replacement of the charm by withdrawing the support post from the ridge piece with a minimal amount of pressure.

FIG. 7 shows a base member 50 for the support of a single charm. FIG. 8 illustrates the base member 52 being supported in a vertical manner by means of the support loop 40. In FIG. 9 the base member 54 has a configuration similar to that shown in FIG. 5 but for accommodating up to five charms. In FIG. 5, as well as in FIG. 9, it is noted that the base member is considered as having a longitudinal axis 30 that is straight. On the other hand, in FIG. 10, the base member is arcuate in shape thus being provided with an arcuate longitudinal axis 31.

Having now described a limited number of embodiments of the present invention, it should now be apparent to those skilled in the art that numerous other embodiments and modifications thereof are contemplated as falling within the scope of the present invention, as defined by the appended claims.

REFERENCE NUMBER LIST jewelry item 10
necklace chain 12
base member 16
rear surface of the base member at 17
charm 18
display end of the charm at 20
support end of the charm at 22
elongated support post 24
opening in the base at 26
longitudinal axis of the straight base member at 30 (FIG. 5)
longitudinal axis of the curved base member at 31 (FIG. 10)
partially spherical securing member 36
rear side of securing member at 36A (FIG. 3)
front side of the securing member at 36B (FIG. 3)
connecting piece of the securing member at 36C (FIG. 3)
distal end ridge piece of the support post at 38 (FIGS. 3-5)
interlocking edge of the ridge piece at 39 (FIG. 3)
support loop 40
FIG. 7 embodiment (single charm) at 50
FIG. 8 embodiment (vertical support) at 52
FIG. 9 embodiment (supports up to five charms) at 54
FIG. 10 embodiment (arcuate shape) at 56

What is claimed is:

1. A jewelry item that is for support from the body of a user in order to display the jewelry item, said jewelry item comprising a base member and at least one charm that is for support from the base member, the charm having a display end where an indicia piece is formed and a support end in the form of an elongated support post, the base member including at least one opening for receiving the support post of the charm so as to retain the charm in place relative to the base member, wherein the base member has a plurality of openings spaced along a longitudinal axis of the base member including a partially spherical securing member that is attached at a rear surface of the base member and about the opening.

2. The jewelry item of claim 1 wherein the indicia piece is in the form of a letter, number, image or symbol.

3. The jewelry item of claim 2 wherein the symbol or image is in the form of a geometric shape, an emoji or a descriptive print.

4. The jewelry item of claim 1 wherein the elongated support post at the support end of the charm has a distal end ridge piece for engagement with the opening in the base member and the partially spherical securing member so as to retain the charm to the base member.

5. The jewelry item of claim 1 including at least one loop on the base member that enables the jewelry item to be hung from a necklace or bracelet.

6. A jewelry item that is for support from the body of a user in order to display the jewelry item, said jewelry item comprising a base member and at least one charm that is for support from the base member, the charm having a display end where an indicia piece is formed and a support end in the form of an elongated support post, the base member including at least one opening for receiving the support post of the charm so as to retain the charm in place relative to the base member including at least one loop on the base member that enables the jewelry item to be hung from a necklace or bracelet wherein a loop is provided at opposite ends of the base member.

7. A jewelry item that is meant for support from a necklace or bracelet for displaying at least one charm, the jewelry item further including a base member from which the at least one charm is for supported, the charm having a display end where an indicia piece is formed and a support end in the form of an elongated support post, the base member including at least one opening for receiving the support post of the charm so as to retain the charm in place relative to the base member wherein the base member has a plurality of openings spaced along a locus of the base member, and including a rear retaining piece disposed at a rear surface of the base member and about each opening, wherein the elongated support post at the support end of the charm has a distal end ridge piece for engagement with the opening in the base member and the rear retaining piece so as to retain the charm to the base member.

8. The jewelry item of claim 7 wherein the indicia piece is in the form of a letter, number, image or symbol.

9. The jewelry item of claim 8 wherein the symbol or image is in the form of a geometric shape, an emoji or a descriptive print.

10. The jewelry item of claim 7 including at least one loop on the base member that enables the jewelry item to be hung from a necklace or bracelet.

11. The jewelry item of claim 10 wherein a loop is provided at opposite ends of the base member.

12. The jewelry item of claim 10 wherein a loop is provided at an intermediate location of the base member.

13. The jewelry item of claim 7 wherein the base member extends either linearly or in an arcuate manner.

14. A jewelry item that is meant for support from a necklace or bracelet for displaying at least one charm, the jewelry item further including a base member from which the at least one charm is for supported, the charm having a display end where an indicia piece is formed and a support end in the form of an elongated support post, the base member including at least one opening for receiving the support post of the charm so as to retain the charm in place relative to the base member, wherein the base member has a plurality of openings spaced along a locus of the base member, and including a rear retaining piece disposed at a rear surface of the base member and about each opening, wherein the elongated support post at the support end of the charm has a distal end ridge piece for engagement with the opening in the base member and for engagement with the rear retaining piece so as to retain the charm to the base member, wherein the indicia piece is in the form of a letter, and where adjacent indicia pieces are determined to form a word or name.

15. The jewelry item of claim 14 including at least one loop on the base member that enables the jewelry item to be hung from the necklace or bracelet.

* * * * *